United States Patent [19]

Curinier et al.

[11] Patent Number: 4,472,234

[45] Date of Patent: Sep. 18, 1984

[54] DEVICE FOR PRODUCING A WEB OF PARALLEL YARNS AND DIFFERENT COMPLEX ARTICLES COMPRISING SUCH A WEB

[75] Inventors: Jean Curinier; Philippe Pinet, both of Le Cheylard, France

[73] Assignee: Etablissements les Fils d'Auguste Chomarat & Cie, Paris, France

[21] Appl. No.: 448,333

[22] Filed: Dec. 9, 1982

[30] Foreign Application Priority Data

Dec. 23, 1981 [FR] France ..... 81 24347

[51] Int. Cl.[3] ..... D04H 3/04

[52] U.S. Cl. ..... 156/439; 28/101

[58] Field of Search ..... 156/177, 439, 440, 181, 156/441; 28/101, 102; 66/84 A

[56] References Cited

U.S. PATENT DOCUMENTS

| | | | |
|---|---|---|---|
| 3,340,584 | 9/1967 | Kalwaites | 28/101 |
| 3,594,256 | 7/1971 | Schuller et al. | 156/440 |
| 3,675,285 | 7/1972 | Atwood | 156/440 |
| 3,701,267 | 10/1972 | Furst | 66/84 A |
| 3,756,893 | 9/1973 | Smith | 156/440 |
| 3,805,341 | 4/1974 | Jenje | 156/439 |
| 3,953,989 | 5/1976 | Politze et al. | 66/84 A |
| 4,068,357 | 1/1978 | Goldsworthy et al. | 28/101 |
| 4,249,981 | 2/1981 | Pelletier et al. | 66/84 A |

FOREIGN PATENT DOCUMENTS

| | | |
|---|---|---|
| 1335418 | 10/1962 | France . |
| 1367567 | 6/1963 | France . |
| 1537811 | 7/1963 | France . |
| 2270185 | 12/1975 | France . |
| 2419991 | 10/1979 | France . |

*Primary Examiner*—Michael W. Ball

*Attorney, Agent, or Firm*—Parkhurst & Oliff

[57] ABSTRACT

Device for producing a weft web constituted of parallel spaced apart yarns.

According to the invention, the yarns are distributed around two continuous endless belts advantageously parallel and supporting a number of pins.

The weft yarns are distributed in such a way that the feeding end of the distributing elements describes by its rotation a plane which cuts through the pulleys supporting the lateral yarn-positioning, securing and advancing means; the pins provided on said lateral means being fixed laterally and the weft yarn, when deposited, resting on the outer faces of the supporting pulleys.

3 Claims, 9 Drawing Figures

Figure 1:
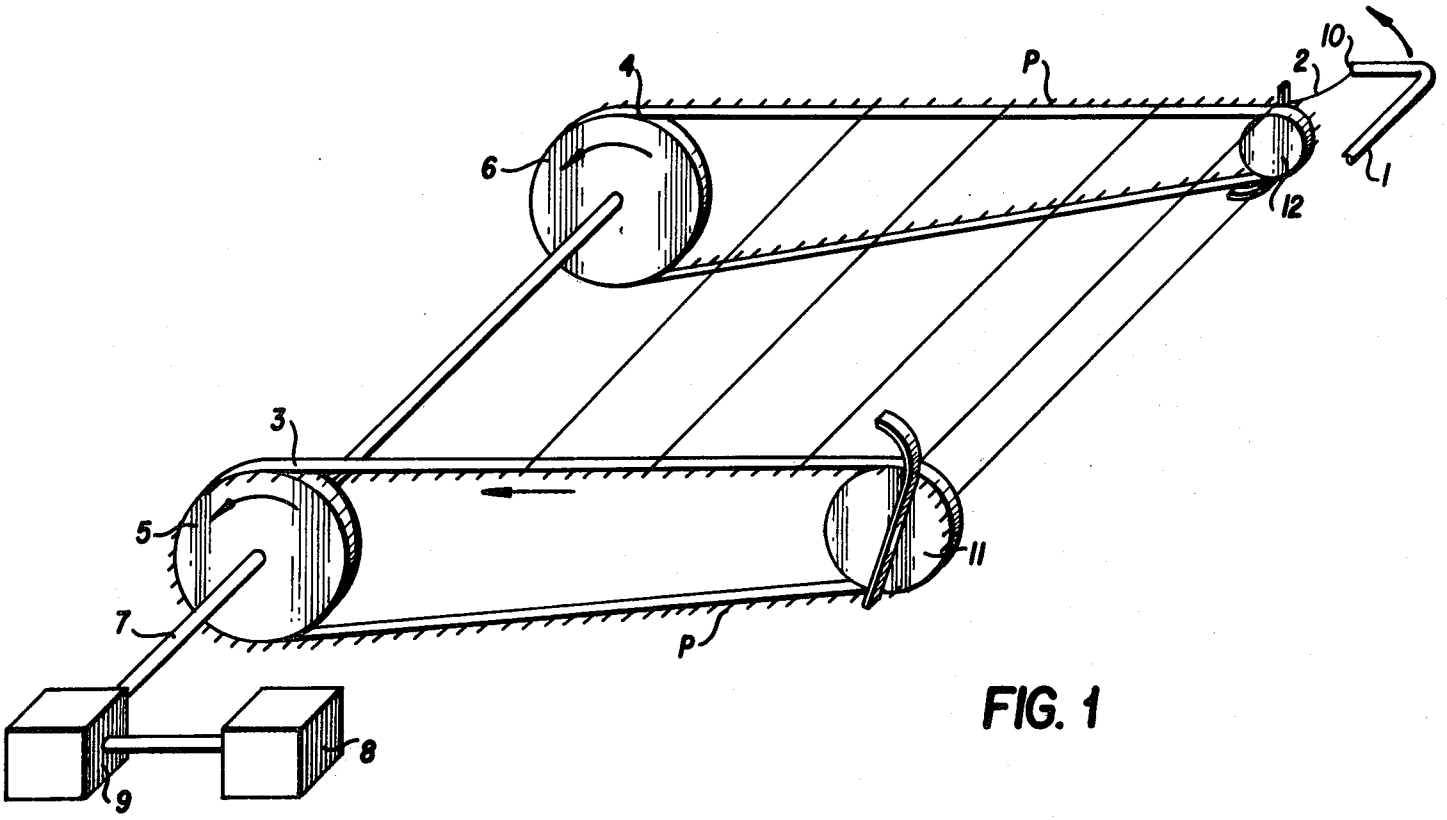

DEVICE FOR PRODUCING A WEB OF PARALLEL YARNS AND DIFFERENT COMPLEX ARTICLES COMPRISING SUCH A WEB

The present invention relates to an improved device for producing a web constituted of parallel spaced apart yarns, extending crosswise with respect to the length of the web. The invention also relates to a device for directly producing complex articles, and in particular non-woven textile patterns, having such a web as one of its constituents.

Such a web is hereinafter termed "weft web" the yarns constituting it being termed "weft yarns".

Many devices are already known and used for producing weft webs designed to be associated to longitudinal parallel yarns, cohesion between the two being obtained for example by adhesive bonding, so as to form articles commonly known as "non-woven textile patterns". In these articles, the yarns of the weft web and those of the warp web or webs are joined together, not by cross-linking as in conventional fabrics, but by joining the yarns at their superposition point, by adhesive bonding, or welding, etc . . . .

Said weft webs can also be used to produce knitted articles according to the so-called "weft insertion by the front" technique, which consists in incorporating, through the entire width of the knitting in production, a weft thread in every row or every so many rows of stitches.

A well-known technique for producing such weft webs is described for example in French Pat. Nos. 1 335 418, 1 367 567 and 1 537 811. This technique generally consists in distributing a plurality of weft yarns around pins situated on two endless belts or chains separated one from the other by a distance corresponding to the width of the web to be produced. According to this technique, the element dispensing the weft yarn is situated above the two endless chains equipped with the pins and is constituted by a rotating assembly which, through its rotation, deposits the yarns between and around said pins.

Such a device is complex, especially because it needs special guiding means for positioning the weft yarns around the pins when the object of the process is to obtain webs made of yarns which are perfectly parallel together. It is also difficult to hold the weft yarns in position around the pins, as said yarns can easily slip off.

Comparable solutions are also described in U.S. Pat. No. 3,340,584 and French Pat. No. 2270185.

According to those documents, the yarn supplying element is constituted by one or more endless belts which distribute one or more yarns by turning around two central spaced-out belts on which pins such as indicated hereinabove, are fixed for holding the ends of the weft yarns. As in the aforementioned patents, it is difficult to hold the weft yarns around the pins, and the risk of the yarns slipping off the pins is always present.

U.S. Pat. No. 3,594,256 describes a solution whereby one (or more) weft yarns are distributed by way of a pivoting arm which, at each rotation, passes in front of spaced-out pins provided for holding the yarn. These pins however, are not fixed on belts, they are instead mounted on a drum inside which they can be retracted to release the produced complex. Thereagain, it is difficult to ensure that the yarn stays around the pins, and what is more, the wefts are not evenly spaced-out one from the other.

It is the object of the present invention to overcome those disadvantages encountered in the prior techniques, by proposing a device designed to solve the problem of holding the ends of the weft yarns in systems where the weft web is produced by distributing the yarns around pins fixed on two endless belts. It is also the object of the invention to solve the problem of maintaining the parallelism between two consecutive wefts and especially to keep a constant and even distance between the wefts.

The problem of securing the ends of the weft loops has already been raised and solved by French Pat. No. 2 419 991 (corresponding to U.S. Pat. No. 4,249,981). Although the solution described in said document is satisfactory when the weft yarns are deposited intermittently, a number of disadvantages have nevertheless to be noted. First of all, said solution is not easily applicable to the techniques in which the weft yarns are distributed continuously. Secondly, the lateral belt being made to advance intermittently, the production speed is reduced and furthermore it is impossible to contemplate fitting such a device in an installation working continuously, such as for example a paper-making machine.

The device according to the invention enables to overcome all the aforesaid problems.

The present invention generally relates to a device used for the production of weft webs constituted of parallel spaced-out yarns, of the type comprising:

means to distribute at least one weft yarn, from a supply source which is either fixed or synchronized with the said means, which latter are moving continuously, means for positioning, securing and advancing the resulting weft web, which means are in the form of two continuous endless belts, advantageously parallel, and separated one from the other by a distance equal to the width of the desired web, said belts being controlled in synchronism with the means distributing the weft yarn, and said belts supporting pins around which are distributed the weft yarns.

The device according to the invention is characterized in that:

the feeding end of the means distributing the weft yarn describes by its rotation, a plane which cuts through the pulleys supporting the lateral yarn-positioning, securing and advancing means, the pins around which are distributed the weft yarns are secured laterally on the endless means and on the yarn-positioning, securing and advancing means, the weft yarn when deposited between the pins, rests on the outer faces of the pulleys supporting said lateral means, the length of yarns bearing on said pulleys being twice as long on one side as on the other.

In other words, according to the invention, if for example, only one weft yarn is dispensed, said yarn will be deposited on one of the sides, the righthand side for example, so as to pass under two pins, whereas on the other side, in this case, the left side, it will be distributed so as to pass under four pins.

According to a preferred embodiment of the invention, the device also has the following additional features:

fixed lateral guides are provided close to the yarn-positioning, securing and advancing means, to accurately guide the weft yarn between the pins during the distribution, a plurality of weft yarns are distributed by means of a pivoting assembly constituted for example by rotary flyers or by a ring equipped with yarn-guides, the yarns being distributed over half the periphery of the said distributing means, the intervals between the pins are not the same over the whole length of the yarn-positioning, securing and advancing means, but they are such that if n yarns are distributed, n intervals are equal to the distance desired between two consecutive wefts, the next interval being reduced by as much as once the thickness of the pins.

Figure 2:
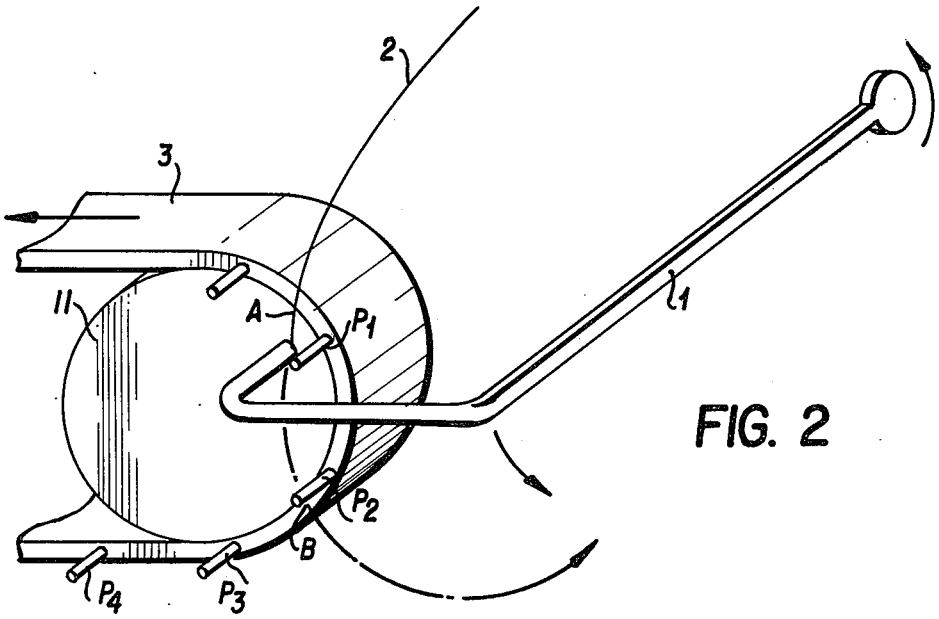
Figure 3:
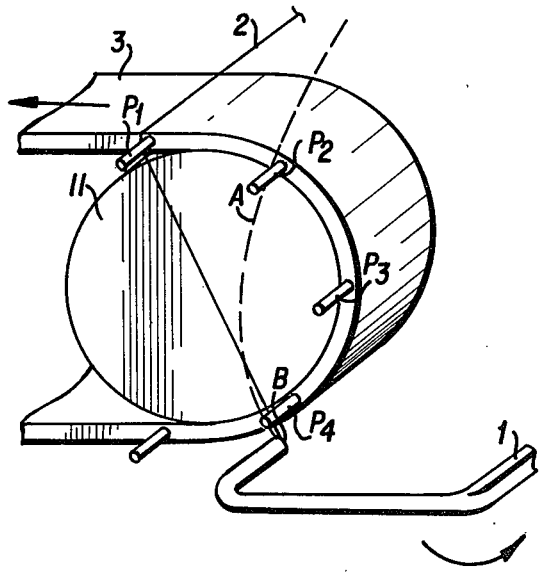
Figure 4:
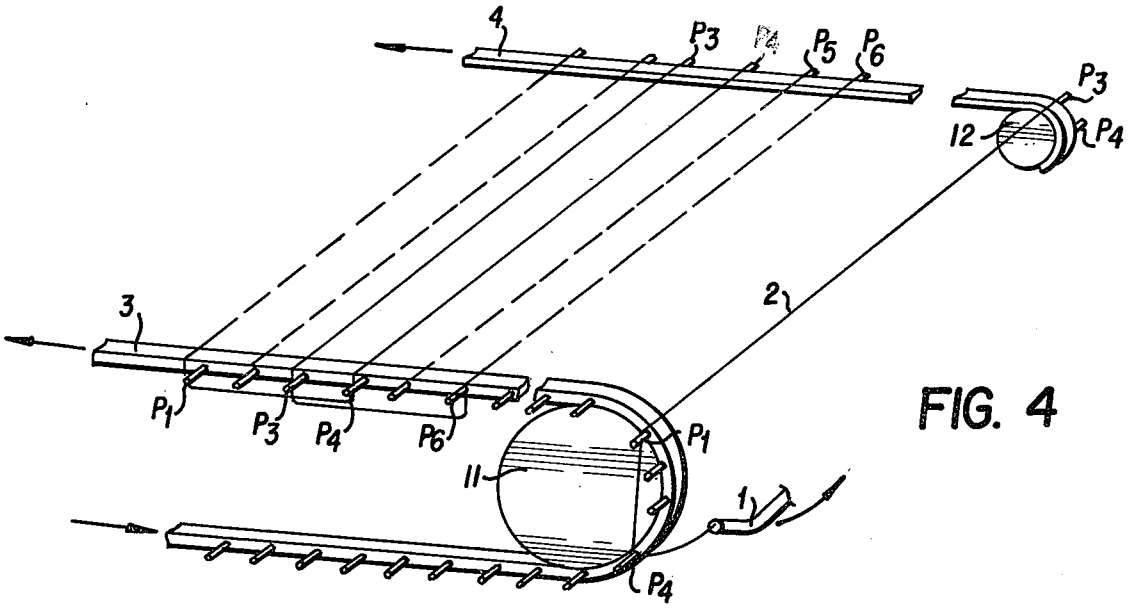
Figure 5:
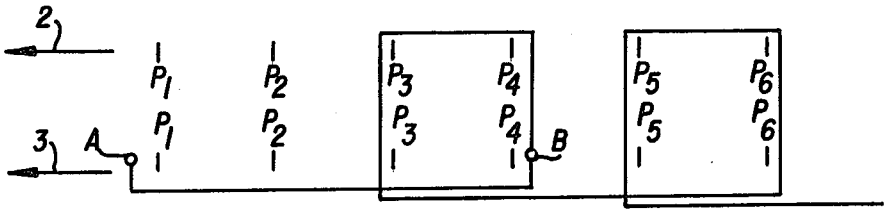
Figure 6:
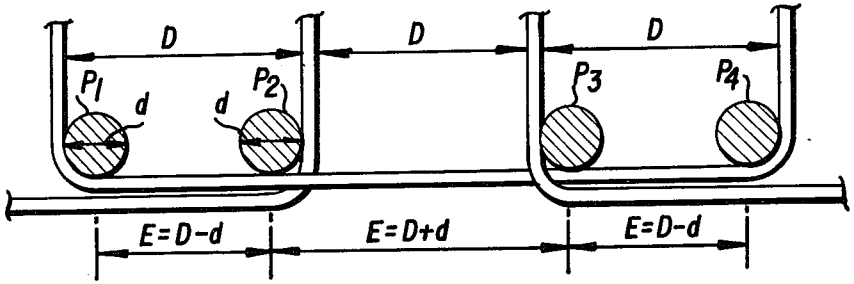
Figure 7:
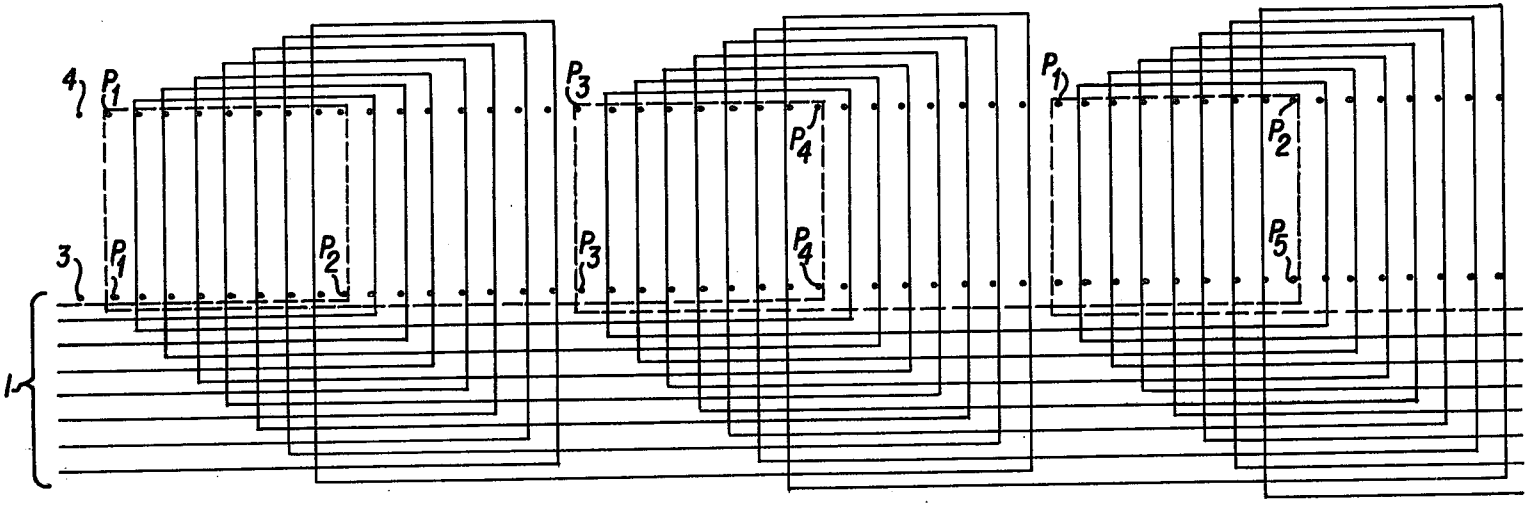
Figure 8:
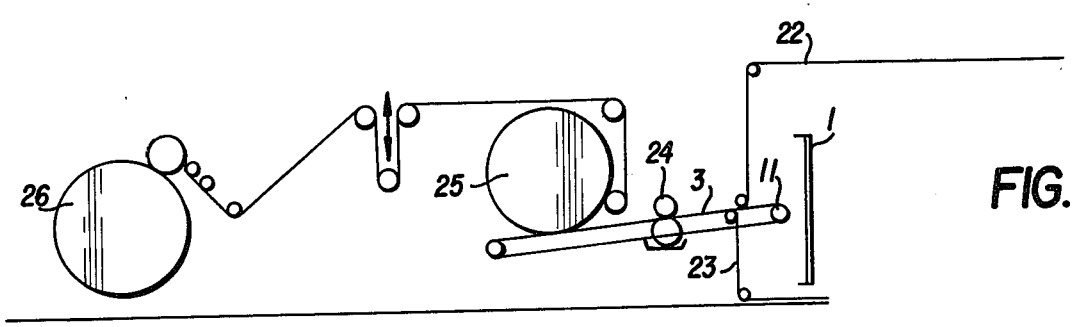
Figure 9:
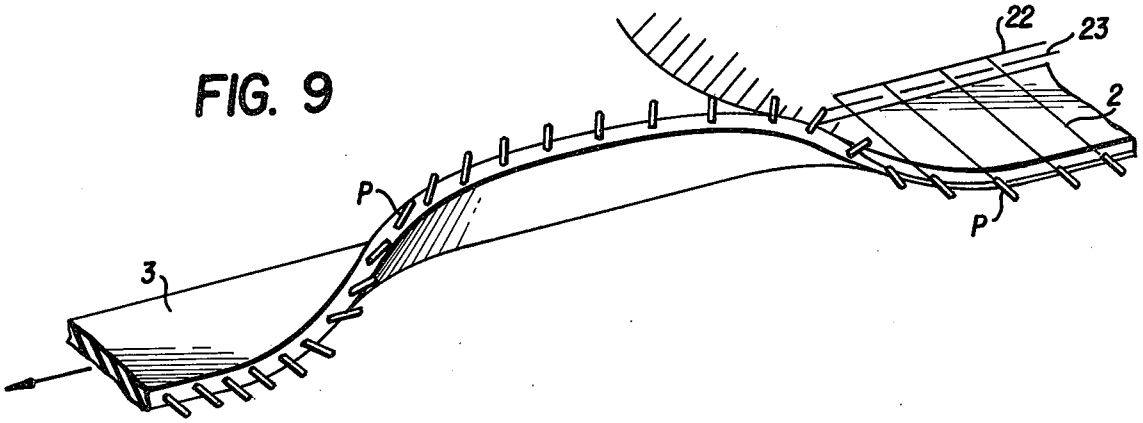

The invention will be more readily understood on reading the following description with reference to the accompanying drawings in which:

FIG. 1 is a diagrammatical perspective view of a device according to the invention permitting to produce a weft web by distribution of a weft yarn, FIGS. 2 and 3 illustrate in more details and in perspective the depositing of a weft yarn between the pins of one of the lateral means for positioning, securing and advancing the weft yarns, FIGS. 4 and 5 are detailed views showing with more precision the structure of a weft web produced according to the invention and more particularly the positioning of the wefts laterally around the holding pins, FIG. 6 is en enlarged view showing the interval variations between the pins designed to obtain regularly spaced apart wefts, FIG. 7 is a deliberately deformed diagram showing a weft web produced according to the invention by distributing eight yarns by rotation of the distributing means, FIG. 8 is a diagrammatical illustration of a complete installation according to the invention for producing a non-woven textile pattern, FIG. 9 is a diagrammatical view illustrating the means for releasing the weft web from the positioning and holding pins.

Referring to the drawings, these show that the device according to the invention for producing a weft web constituted of spaced apart parallel yarns is of the type comprising, on the one hand, means (1) for distributing at least one weft yarn (2) and on the other hand, means for positioning, securing in position and advancing over the resulting web of weft yarns, which means are in the form of two continuous endless belts (3 and 4) separated one from the other by a distance equal to the width of the web to be produced, said means being controlled in synchronism with the weft yarn distributing means (1). According to the embodment shown in FIG. 1, the positioning means (3-4) are constituted by two endless belts driven by way of two pulleys (5-6) both carried by the same control shaft (7) which is driven by a motor (8) associated to a speed variator (9) permitting to synchronize the forward movement of the means (3-4) with the displacement of the yarn distributing means (1). In practice, the two belts (3-4) are identical in length and tensioning elements can also be provided to guide them and/or to hold them stretched.

In the illustrated case, the yarn distributing means (1) are constituted by a rotating flyer inside which passes the yarn to be distributed, but of course, any other equivalent means can be used, such as for example, of the type constituted by an endless belt or rotating ring equipped with yarn-guiding elements. Such yarn distributing means being well-known of anyone skilled in the art, these are not being described hereafter in detail. Likewise, when several weft yarns are simultaneously distributed, it is obvious that other means should also be provided to prevent these yarns from tangling when they are supplied to the distributing means. Such other means being also well-known, they are not being described hereafter in detail.

According to the invention, to secure the ends of the wefts around the pins and to keep a constant interval between two successive wefts, the device according to the invention has the following characteristics.

First of all, the outlet end of the distributing element (1) describes in its rotation a plane which cuts through the pulleys (11-12) supporting the belts (3-4).

Moreover, the pins, generally referenced as P, are placed sideways on the endless belts (3-4) and protrude externally from the surface of the pulley (11-12).

Finally, when being deposited between the pins, the weft yarn (2) rests on the outer faces of the supporting pulleys (11-12) and this so that the length of yarn bearing on one of the pulleys, such as (11) for example, is twice that bearing on the other pulley (12). This is obtained quite simply by using two pulleys (11-12) of different diameter, the pulley (12) being, in the illustrated case, twice smaller than the pulley (11).

With such a yarn depositing system, the yarns are secured in position in that said yarn, having passed between the pins P, bears on the surface of the belts (3-4) and goes around the said pins P as illustrated in detail in FIGS. 2, 3 and 4.

To obtain a perfect parallelism between the weft yarns and a constant interval between them through the length of the web, the yarn is deposited as follows. For simplification purposes, the depositing method will be described in relation to the distribution of one yarn only, the invention being however applicable to the case of a plurality of yarns being distributed one after the other.

The depositing method such as clearly illustrated in FIGS. 2, 3, 4 and 5 is as follows.

Assuming that the starting point is the position A shown in FIG. 2, the yarn is brought over the front of the pin $P_1$. Due to the continuous advance of the belts (3-4) and to the rotation of the distributing element 1, when said element reaches point B (see FIG. 3), the yarn (2) is then brought at the back of the pin $P_4$.

On the pulley (11), the yarn is therefore around four pins at each passage of the distributing element.

On the righthand side on the contrary, the yarn is brought on the pulley (12) around only two pins, the diameter of pulley (11) is twice that of pulley (12). The yarn is brought on the side of the pulley (12) first at the back of pin $P_4$ and then at the back of pin $P_3$.

At the next run, the yarn is deposited at point A in front of pin $P_3$ and then at point B at the back of pin $P_6$, and on the side of pulley 12, said yarn is brought on the back of pin $P_6$ and then to the front of pin $P_5$.

A weft web is thus obtained which has the texture illustrated in FIG. 5.

To obtain a constant and regular interval between each deposited weft, the pins P are placed at irregular intervals one from the other, such as illustrated in FIG. 6.

In the case of only one weft being deposited, the interval E1 between the pin $P_1$ and the pin $P_2$ is equal to the distance D required between two wefts less the thickness d of the pins, whereas between pin $P_2$ and pin $P_3$, the distance E2 between each pin is equal to the distance D required between two wefts plus once the thickness of said pins. It is easily conceivable that with such a distribution the wefts remain equally spaced apart.

It should also be noted that such a device can be used to distribute more than one weft at a time, for every rotation of the distributing means. This is clearly shown by the diagram of FIG. 7 which represents a weft web obtained according to the invention by distributing eight weft yarns. In this particular case, the eight yarns are regularly distributed over a rotation of 180°.

As with only one yarn, in order to obtain a perfectly constant interval between two consecutive wefts, the pins will be situated at regularly intervals, the distance between them being more or less equal to the thickness of one pin depending on whether two consecutive wefts are reversedly placed.

FIG. 7 illustrates how is constituted a weft web obtained according to the invention by distributing eight elementary yarns. On said Figure of course, the proportions have not been respected, the center part being considerably reduced and the lateral parts being on the contrary enlarged to give a better idea of how the different yarns are positioned one with respect to the other.

It is also possible with the device according to the invention to produce different complex articles which comprise such a weft web.

FIG. 8 gives a side view of a complete installation to produce continuously non-woven textile patterns wherein the weft web is associated to warp webs.

Such an installation comprises upstream of the weft yarn distributing means (1) (not shown), an assembly for storing the yarn feed bobbins. Said assembly can be for example an assembly which is pivotable synchronously with the distributing means (1), and being of a conventional type, it is not described in detail herein and said assembly supporting the feed bobbins (not shown for simplification purposes). The distribution means (1) deposit the weft yarns on side elements provided for positioning, advancing and holding the yarns, such as those described hereinabove and illustrated in FIG. 1. After depositing the weft yarns, two warp webs (22-23), an upper one (22) and a lower one (23), are brought on either side of the formed weft web. The whole assembly passes through a bonding system (24) wherein a bonding material is deposited on the weft and warp yarns. The resulting pattern is then brought over a drying drum (25) and over return elements to be wound at (26). In such an installation, the drying drum (25) is preferably situated above the conveying elements. This enables, as illustrated in FIG. 9, to obtain an easy and automatic release of the ends of the weft loops. Indeed, due to the presence of the lower warp web (23), the weft yarns are raised when the pattern is around the drum (25) and the side belts (3 and 4) are curling up, this allowing the ends to be released. Of course, this particular embodiment is not restrictive and other means can be used to release the ends of the weft yarns, such as two slightly convergent lateral belts (3-4) for example. Selvedge yarns could also be incorporated inside the weft loops. Or else, the ends could be simply cut.

The foregoing examples clearly illustrate the advantages brought by the invention and amongst these the fact that during the production of the weft web, the ends of the formed loops are secured in position and a perfect parallelism of the wefts is obtained with a constant interval between each weft.

The installation according to the invention can, not only be used for producing non-woven textile patterns, it can also be associated to paper-making machines, knitting machines, etc . . . .

What is claimed is:

1. A device for producing a weft web of parallel spaced apart yarns, of the type comprising: means to distribute at least one weft yarn from a supply source which is either fixed or synchronized with said means, which latter are moving continuously; means for positioning, securing and advancing the resulting weft web, which means are in the form of two continuous endless parallel belts separated one from the other by a distance equal to the width of the desired web, said belts being controlled in synchronism with the means for distributing the weft yarn, and said belts supporting pins around which are distributed the weft yarns, wherein the feeding end of the means distributing the weft yarn describes by its rotation, a plane which cuts through pulleys supporting said two endless belts, the pins around which are distributed the weft yarns being secured facing laterally outwardly on the two endless belts of the yarn-positioning, securing and advancing means, the weft yarn when deposited between the pins, resting on the outer faces of the pulleys supporting said two endless belts, the length of yarn bearing on said pulleys being twice as long on one side as on the other.

2. Device as claimed in claim 1, wherein the intervals between the pins are not the same over the whole length of the yarn-positioning, securing and advancing means, but they are such that if n yarns are distributed, n intervals are equal to the distance desired between two consecutive wefts, the next interval being reduced by as much as once the thickness of the pins.

3. Device as in claim 1 wherein, after depositing the weft yarns on the pins, means are provided to supply two warp webs, an upper one and a lower one on opposite sides of the formed weft web, the whole assembly being thereafter passed through a bonding system and through a drying drum situated preferably above the conveying elements, the lower warp web causing the automatic release of the ends of the weft loops, from the said pins.

* * * * *